US008461983B2

(12) United States Patent
McCauley

(10) Patent No.: US 8,461,983 B2
(45) Date of Patent: Jun. 11, 2013

(54) PERSONAL SECURITY DEVICE

(76) Inventor: Michele McCauley, Boca Raton, FL (US)

( * ) Notice: Subject to any disclaimer, the term of this patent is extended or adjusted under 35 U.S.C. 154(b) by 734 days.

(21) Appl. No.: 12/558,217

(22) Filed: Sep. 11, 2009

(65) Prior Publication Data

US 2010/0066558 A1 Mar. 18, 2010

Related U.S. Application Data

(60) Provisional application No. 61/191,873, filed on Sep. 13, 2008.

(51) Int. Cl.
*G08B 1/08* (2006.01)

(52) U.S. Cl.
USPC ..... 340/539.13; 340/539.1; 340/539.11; 340/541; 340/573.1; 340/825.49; 455/404.1; 455/521

(58) Field of Classification Search
USPC ..... 340/539.13, 539.11, 539.1, 541, 340/573.1, 825.49, 825.69, 825.72; 455/404.1, 455/456.1, 521, 90.1
See application file for complete search history.

(56) References Cited

U.S. PATENT DOCUMENTS

| | | | | |
|---|---|---|---|---|
| 3,683,114 | A | 8/1972 | Egan et al. | |
| 5,225,809 | A | 7/1993 | Bunn | |
| 5,515,419 | A | 5/1996 | Sheffer | |
| 5,517,199 | A | 5/1996 | DiMattei | |
| 5,808,564 | A | 9/1998 | Simms et al. | |
| 5,898,367 | A | 4/1999 | Berube | |
| 6,044,257 | A * | 3/2000 | Boling et al. | 455/404.2 |
| 6,073,044 | A | 6/2000 | Fitzpatrick et al. | |
| 6,285,318 | B1 | 9/2001 | Schoen et al. | |
| 6,496,111 | B1 | 12/2002 | Hosack | |
| 7,038,590 | B2 | 5/2006 | Hoffman et al. | |
| 7,308,246 | B2 * | 12/2007 | Yamazaki et al. | 455/404.1 |
| 8,013,734 | B2 * | 9/2011 | Saigh et al. | 340/539.13 |
| 2007/0082652 | A1 | 4/2007 | Hartigan et al. | |
| 2007/0182548 | A1 * | 8/2007 | Raad | 340/539.13 |
| 2007/0200716 | A1 * | 8/2007 | Haase et al. | 340/574 |

* cited by examiner

*Primary Examiner* — Hung T. Nguyen
(74) *Attorney, Agent, or Firm* — Allen F. Bennett, P.A.

(57) ABSTRACT

A security device with a locator module and an identifier module sends an alert signal to warn others of an emergency situation. The security device uses a wireless transceiver to transmit the alert signal and a monitoring center. Location information updates and an audio signal are sent to the monitoring station. The security device may be located within an outer casing that conceals its functionality.

15 Claims, 5 Drawing Sheets

PERSONAL SECURITY DEVICE

CROSS-REFERENCE TO RELATED APPLICATION

This application is related to and claims priority to U.S. Provisional Application No. 61/191,873 filed Sep. 13, 2008, entitled PORTABLE SECURITY DEVICE, the entirety of which is incorporated herein by reference.

STATEMENT REGARDING FEDERALLY SPONSORED RESEARCH OR DEVELOPMENT n/a

FIELD OF THE INVENTION

The present invention relates to a personal security device that allows an individual to inconspicuously report an emergency situation. The invention provides the location of the person in distress and allows audio monitoring of the emergency situation.

BACKGROUND OF THE INVENTION

Despite extensive security measures, a robust police system and numerous security companies, personal safety remains a serious issue in today's society. Robbery and kidnapping occur with alarming frequency. Every year we hear of numerous incidents of kidnappings, murders and sexual assaults. Victims are often women and children unable to escape from an armed and dangerous assailant. Too often we hear of girls new to college assaulted on campus. Women and children are abducted from mall parking lots. Even in neighborhoods children may be picked up by strangers tempting them with candy or other treats. Awareness of these dangers is often insufficient protection. An armed assailant may easily force a victim into his car with only the threat of violence.

Assailants are often mentally unstable and a victim's risk of injury in their custody is increased by attempts to escape or call for help. Use of defensive devices such as pepper spray offer an opportunity to escape but also run the risk of angering an assailant and incurring his or her wrath. More effective deterrents such as fire arms are not a desirable solution as they only increase the level of violence in our society. The victim is less likely to be harmed during the initial contact with an assailant if he or she puts up little resistance.

The most preferred way of handling a dangerous assault situation is to promptly alert authorities skilled in confronting dangerous criminals and rescuing victims. As a result, a number of methods have been developed that allow a person to alert authorities of a dangerous or harmful situation. The most obvious method is to use a cellular telephone to call police. These communication devices have long since become a staple gadget in our society. However, it is impractical to attempt to call authorities after an assault. An assailant may merely take away a cell phone and dispose of it.

Many devices have been developed to send an emergency signal to indicate that a person is in distress. Cell phones themselves may have a speed dial number or even a button particularly programmed to directly call authorities. However, such a device is impractical to the victim of a kidnapper or sexual molester. Such emergency call methods are well known and it is unlikely that an assailant will allow a victim to operate a cell phone once abducted. Other well known methods include a 'panic button' on a necklace or similar device in radio communication with a transceiver that is connected to a telephone or similar network. These devices are compact, but have a very limited range.

Other devices, designed for persons far from civilization, such as when camping or hiking, send a distress signal via satellite. They are typically bulky due to a relatively large battery as required for long term usage. They are also extremely rugged to survive difficult terrain and circumstances. Their use of satellites to communicate and determine location is ideal for wilderness environments, but not necessarily reliable in an urban environment where a user may not have direct line of sight to satellites. They are also impractical to carry inconspicuously and/or in a pocket.

Other devices are smaller and better suited for personal day to day carrying and use. However, these devices often are still tied to a transceiver that must be located nearby. Other devices either send no signal to the user confirming receipt of the alert message, or send a confirmation signal that is likely to be noticed by an assailant.

It is therefore desirable to provide a quick and inconspicuous way to convey an alert and provide tracking capabilities for authorities during a hazardous situation.

SUMMARY OF THE INVENTION

A security device comprises a control module, a transceiver in communication with the control module, the transceiver operable for sending and receiving signals, a trigger in communication with the control module, the trigger operable to actuate transmission of a signal by the transceiver, a location module in communication with the control module, the location module identifying a location of the security device and a microphone coupled to the control module. The control module, transceiver, trigger, location module and microphone are optionally disposed within an outer concealment casing. A confirmation indicator is optionally in communication with the control module and conveys a confirmation signal when the transceiver receives a receipt signal. The confirmation indicator provides a vibrating response to indicate that the receipt signal has been received. Optionally, the confirmation indicator includes an illuminating device. The confirmation indicator may include an audio device. The transceiver sends an alert signal including a device identifier, a location of the security device and an audio signal upon actuation of the trigger. Optionally, the security device also comprises a cover slidably positionable about the trigger. The location module may include a Global System for Mobile device, a Global Positioning System device and/or an Assisted Global Positioning System device. The transceiver may include a Subscriber Identity Module.

A security device may comprise a case, a rechargeable power supply within the case, a verification switch at least partially disposed within the case, a trigger coupled to the case, a cover slidably positionable over the trigger, an assisted global positioning system location module disposed within the case, a microphone coupled to the case, a transceiver disposed within the case, the transceiver including a Subscriber Identity Module and a vibrating confirmation indicator disposed within the case. The security device may further comprise a concealment casing surrounding at least a portion of the case.

A method for summoning emergency assistance comprises providing a security device comprising a location module, a device identifier module, a transceiver, a trigger, a confirmation indicator and a microphone, activating the trigger, where activation of the trigger actuates the transceiver to send an alert signal including a security device identity, a security device location and an audio signal to a monitoring station, transmitting a receipt signal form the monitoring station to the transceiver and actuating the confirmation indicator upon receipt of the receipt signal. The method may additionally comprise contacting an emergency assistance provider. The method may optionally also comprise impinging a verification switch to verify that the security device is functioning properly. Activating the trigger may include depressing the trigger for a predetermined length of time. Activating the trigger may include depressing the trigger until the security device receives the receipt signal. Activating the trigger may include depressing the trigger a plurality of times.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
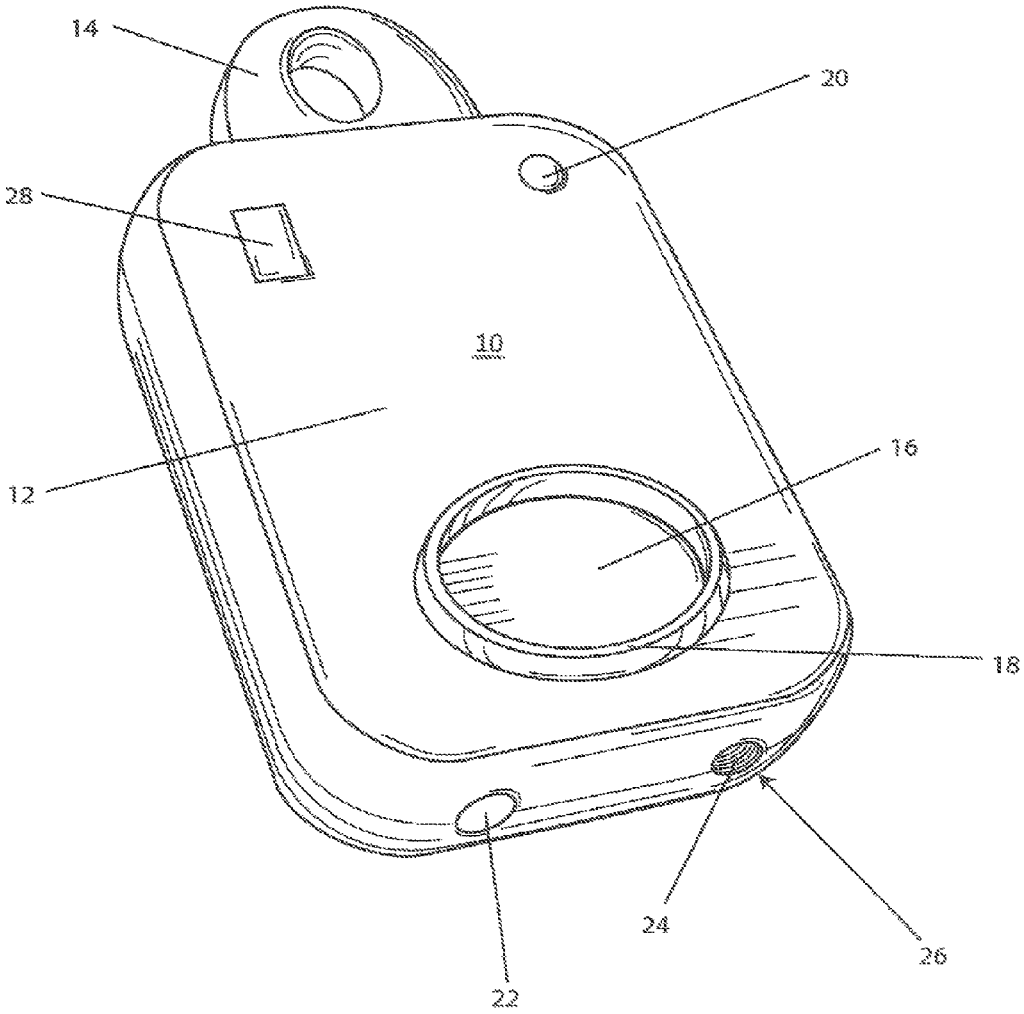
FIG. 1 is a perspective view of the apparatus of the invention.

The present invention provides a clandestine security device that communicates through a cellular telephone or other similar network. When triggered, the security device sends an emergency alert signal through the cellular network to a monitoring station. The device has its own identifier that allows the monitoring station to identity who has sent the alert signal. The device also includes a positioning system and includes the location of the individual as part of the alert signal.

The monitoring station sends a signal acknowledging connection to the device and receipt of the alert signal. The device then provides a discrete confirmation signal to notify the operator that the monitoring station is aware of the emergency situation. The monitoring station then listens to an audio signal provided by the device to ascertain whether a true emergency has occurred and which authorities to contact. Optionally, the monitoring station listens for the operator to utter code words that inconspicuously notify the monitoring station of the nature of the situation. If a true emergency is occurring, the monitoring station notifies the police or other authorities. If the alert signal was sent by mistake, the monitoring station confirms a false alarm with the operator.

The security device is preferably small and easily disguisable as a key fob, pendant, or similar object, and is constructed of durable, waterproof material. It has a trigger the operator actuates in order to send an alert signal. The trigger may be a button which the operator depresses for a period of time. This prevents accidental activation of the trigger when the device is stored in a pocket, purse, or similar location. Alternatively, the trigger may require two or more steps to actuate. For example, the trigger may have a cover that must first be slid out of the way. Alternatively, the trigger may require several turns or rotations in place of or in addition to being pressed. The security device is optionally powered by a rechargeable battery.

It is therefore an object of the present invention to provide an inconspicuous security device to send an emergency alert signal including the operator's location to a monitoring center.

The invention is not limited to the details of construction and to the arrangements of the components and steps set forth in the following description or illustrated in the drawings. The invention is capable of other embodiments and of being practiced and carried out in various ways. The phraseology and terminology employed herein are for the purpose of description and should not be regarded as limiting.

FIG. 1 shows an exemplary security device 10 of the present invention. Security device 10 is similar in size and appearance to a common car lock key fob and contained within case 12. Case 12 is preferably made from hard plastic or a similar material. Case 12 is also preferably water resistant. This embodiment of the security device 10 is relatively inconspicuous and easily fits within an operator's pocket and preferably includes lanyard loop 14 for attachment to a keychain or other lanyard. The case 12 contains several internal components including a location module and a transceiver. In use the transceiver sends an emergency alert signal to a remote monitoring station which then monitors the location and audio signal from the device to determine whether a true emergency exists.

The invention is a relatively nondescript device having relatively few visible components. This makes the device less conspicuous. Trigger 16 is recessed and surrounded by rim 18 to decrease the likelihood of accidental depression of trigger 16. In this embodiment, trigger 16 is activated by continuously depressing trigger 16 for an extended time period, optionally about 5 seconds. Because the alarm trigger is only activated by continuous depression, accidental triggering is prevented. Activation of the trigger may optionally be performed by depressing trigger 16 in a pattern. For example, trigger 16 may be activated by depressing the trigger three consecutive times, for 3 seconds each time. It may be desirable to keep trigger 16 depressed until the device receives a receipt signal and conveys a confirmation signal to the operator. When the trigger 16 is activated, the alert signal is initiated.

Security device 10 includes a confirmation indicator. The confirmation indicator is actuated upon receipt of a signal from a monitoring station that an alert signal sent by the device has been received. The confirmation indicator conveys to the operator a confirmation signal, informing the operator that the alert signal sent by the device has been received by the monitoring station. This embodiment includes a visual indicator 20 as a confirmation indicator. Indicator 20 may be an LED or other similar light emitting device. The confirmation signal may include the illumination of visual indicator 20. Optionally, an audio indicator may be used to convey a confirmation signal. The device may include only a vibrating mechanism such as those commonly provided with cellular phones. A vibrating mechanism is preferred for providing the confirmation signal as a vibration is less conspicuous than a light or sound. Alternatively, all three signal mechanisms, a vibrator, a visual indicator and an audio signal device may be included.

Security device 10 also includes a recharging jack 22. Recharging jack 22 allows the device 10 to be connected to a battery recharger. The invention preferably includes a rechargeable power supply. Optionally, the invention may be designed to run on a replaceable battery. However, a rechargeable supply is preferred as it is more compatible with a securely enclosed and water resistant case. Those skilled in the art will appreciate that the recharging jack 22 may be replaced with recharging pads. Any power supply is suitable for the device so long as it is compact and capable of being recharged.

Device 10 also includes a recessed verification switch 24. Verification switch 24 is a small button located within a small opening 26 and is only accessible using a small tool such as a paperclip. Depressing this switch 24 actuates the confirmation signal, verifying that the device is charged and operating properly. Optionally, depressing verification switch 24 may also reboot any software or firmware of the device.

Device 10 also includes a microphone 28 for monitoring the potential emergency situation surrounding the device. The microphone 28 is inconspicuous and allows the device to receive and transmit any conversation, dialogue or other sounds in the immediate vicinity of the device.

Figure 2:
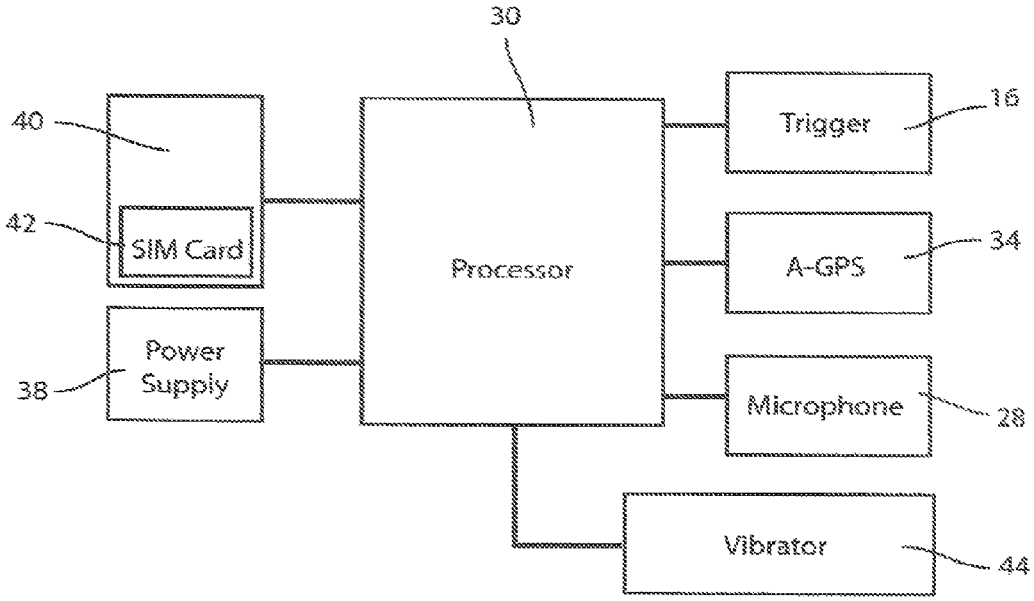
FIG. 2 is a schematic diagram of the invention.

FIG. 2 shows a schematic diagram of the invention. A central processor 30 controls the security device. It is powered by power supply 38. Power supply 38 provides power for all of the electrical components of the security device. Although in this schematic diagram power supply 38 is shown connected to central processor 30, those skilled in the art will appreciate that it may provide power directly to individual components and/or include a power distribution component.

Trigger 16 is also connected to central processor 30. Processor 30 identifies when the trigger has been properly activated. Microphone 28 is also connected to processor 30. Microphone 28 is preferably very sensitive to enhance reception even when device 30 is in a pocket or purse. Location module 34 provides processor 30 with the location of the device. An A-GPS (Assisted Global Positioning System) circuit is preferred as it combines positioning by both GPS and cell tower triangulation. However, a standard Global Positioning System (GPS), Global System for Mobile (GSM) or cell tower triangulation device may also be used. The location module allows the device to accurately identify its location. Inside buildings and in parking decks, pure GPS devices do not have a line of sight to satellites and therefore function poorly. A-GPS is preferred because it also uses the cell phone tower network to identify its location and therefore is better suited for an urban environment.

Processor 30 is also connected to a transceiver 40. Transceiver 40 is preferably a compact cell phone device that only dials a single number over one or more cell phone or similar wireless networks. Transceiver 40 includes an identifier module 42 that provides an identity for the security device and allows a monitoring station to immediately identify the source of the alert signal upon receipt. In this embodiment, the identifier module 42 comprises a Subscriber Identity Module (SIM) card. Optionally, a monitoring station may "ping" the device so as to determine its location even when there is no known emergency. When trigger 16 is activated, processor 30 instructs transceiver 40 to call the monitoring station and provide the device's identification and location as determined by the location module 34. The Processor 30 also provides the audio signal recorded by microphone 28 to transceiver 40 to be transmitted over the network. When the transceiver receives a receipt signal from the monitoring station, processor 30 creates a confirmation signal by actuating the confirmation indicator 44. FIG. 2 shows a confirmation indicator 44 comprising a vibrating device. Optionally, processor 30 may also create a confirmation signal by illuminating a visual indicator such as the LED in FIG. 1.

Figure 3:
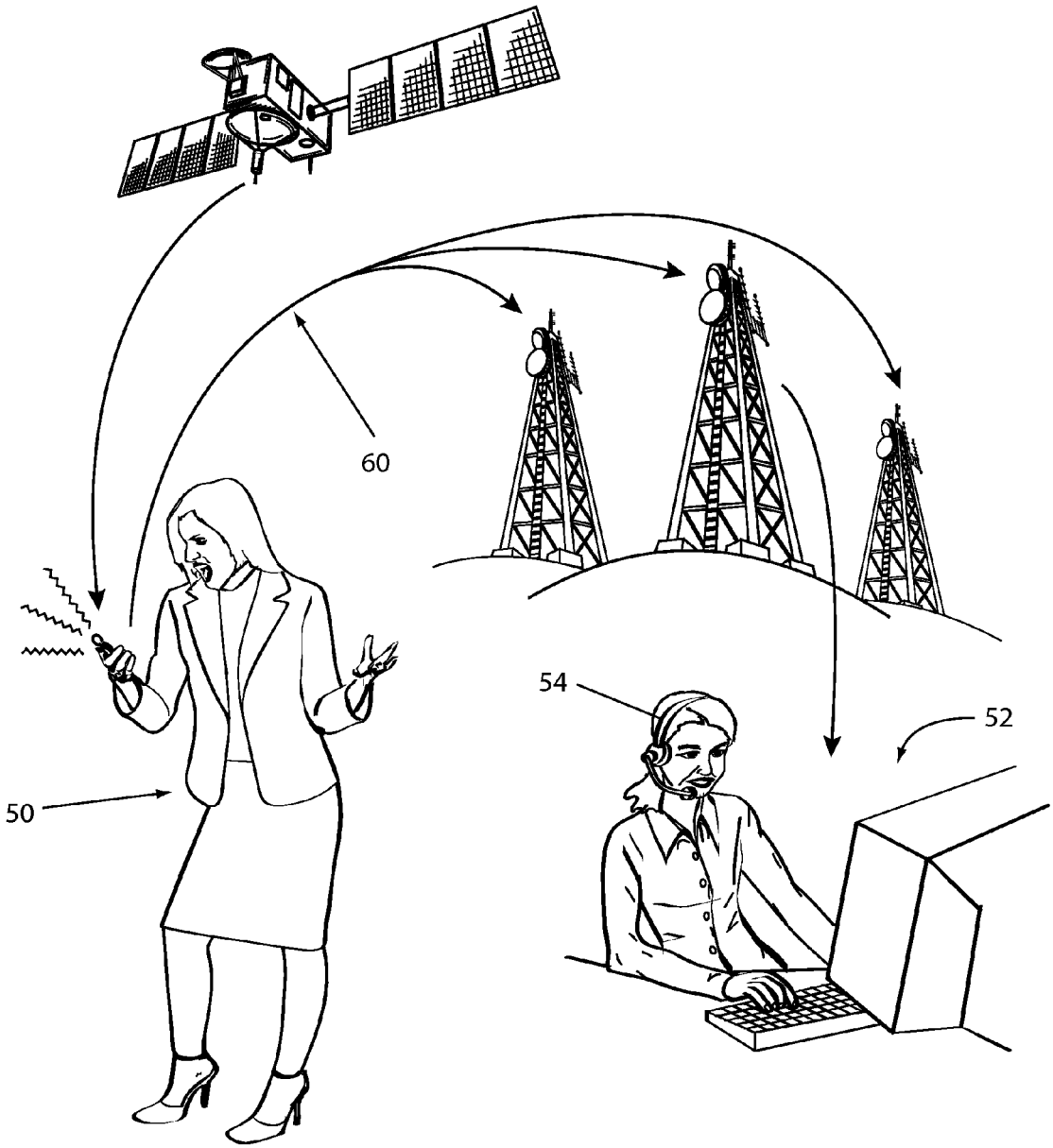
FIG. 3 is an environmental view of the invention.

FIG. 3 shows an environmental view of an operator 50 carrying security device 10. Upon realizing that she is in an emergency situation, operator 50 activates the trigger 16 of the security device. Activation of the trigger 16 initiates a sequence of events resulting in the sending of an alert signal. Immediately, processor 30 requests location data from the locator circuit 34. Locator circuit 34 determines the location of the device using GPS, cell tower triangulation or both and provides the information to processor 30. Processor 30 sends the location information to the transceiver 40 which then transmits the alert signal 60 to monitoring station 52. The alert signal 60 comprises the device's location and identity and an audio signal. Alert signal 60 travels over a cellular phone network to monitoring station 52. When monitoring agent 54 receives the alert signal, he or she sends a receipt signal to the device. Optionally, the monitoring station 52 may include software that automatically transmits the receipt signal upon receipt of the alert signal. The device then provides a confirmation signal to the operator in the form of a vibration, a visual signal, an audio signal or a combination of the three. The device then provides regular updates of its location and audio signal to the monitoring station. The monitoring agent 54 listens to the audio signal from the device to determine whether the alarm signal was sent accidentally or whether a true emergency situation exists. Optionally, the monitoring agent may listen for specific code words submitted by the operator at an earlier time that indicate the nature of the emergency. Further, if the operator has no need to be discrete, the operator may simply tell the monitoring station agent 54 what the nature of the emergency is. However, one of the features of the invention is that an assailant may not readily discern that an alert signal has been transmitted. In this situation, the operator may wish to avoid revealing the nature of the security device and not speak directly to the monitoring agent.

If the monitoring agent 54 determines that a true emergency situation has arisen, the agent notifies the proper authorities, such as police, fire or rescue officers of the location and any information gleaned from listening to the audio signal. In this manner, authorities can be notified of an emergency situation and help may be sent to the operator without an assailant knowing that the victim has taken any steps to acquire assistance. The confirmation signal inconspicuously provides the operator with the security of knowing that his or her distress call has been received and that assistance is on the way.

Figure 4:
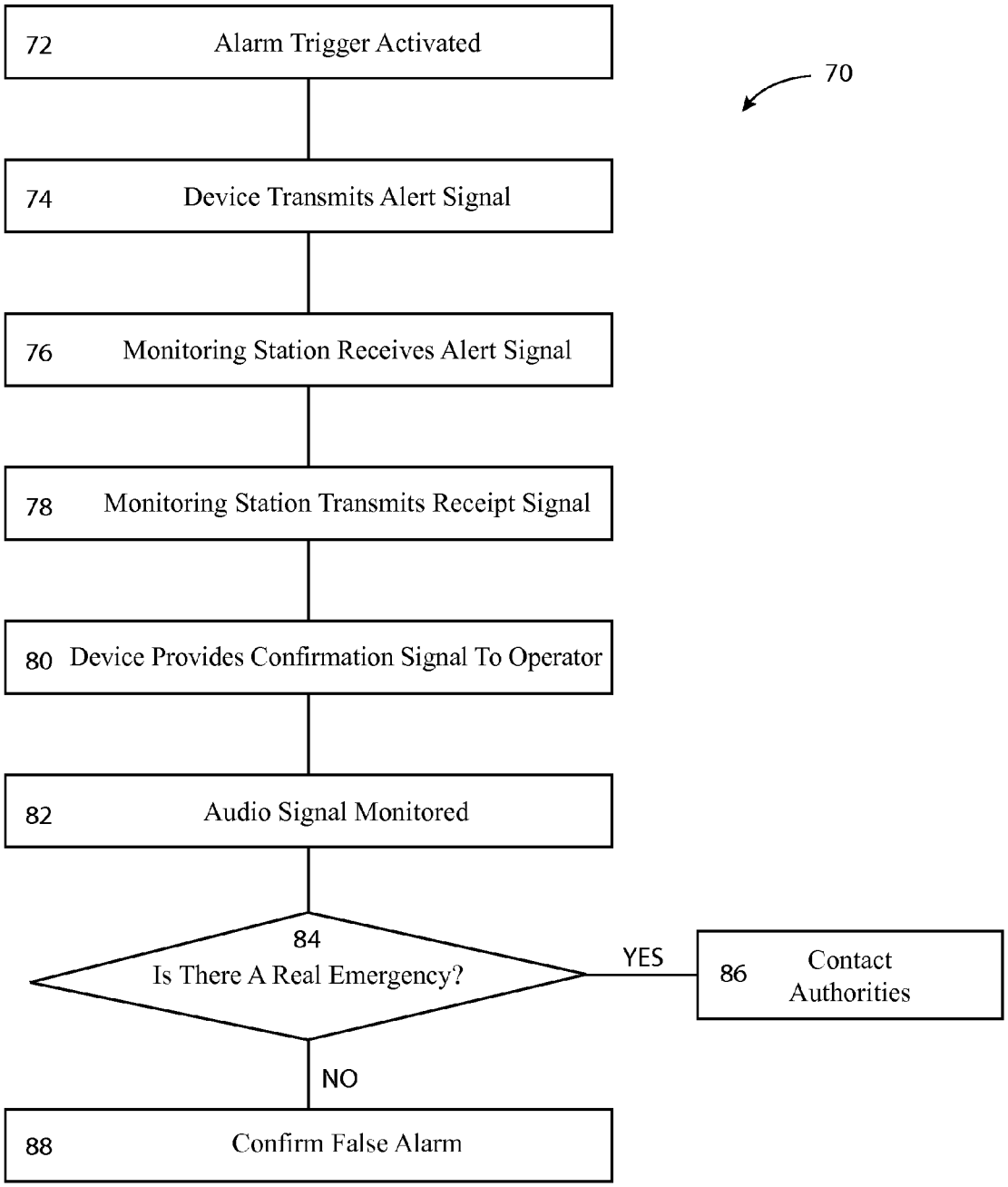
FIG. 4 is a flow chart of the invention.

Referring to FIG. 4, flow chart 70 shows how the security device of the present invention is used. The alarm trigger is activated 72 causing the device to send an alert signal 74 to the monitoring station. The monitoring station then receives the alert signal 76. The alert signal includes with it the location of the device as determined by the locator circuit. The monitoring station also identifies the device by its SIM card or similar device. This allows the monitoring station to readily determine the identity and location of the person sending the alert signal. The device also sends the audio signal received from the microphone. The monitoring station then transmits a receipt signal 78 back to the security device. Once the security device receives the receipt signal, it conveys a confirmation signal 80 to the recipient. As explained, the confirmation signal is preferably inconspicuous, comprising a vibration and/or visual indicator and/or an audio indicator. The monitoring station continues to monitor the audio signal from the security device to ascertain the nature of the potential emergency. The monitoring station makes a determination 84 as to whether a real emergency exists or the security device was accidentally triggered. If the monitoring station concludes that the device was accidentally triggered 88, then the monitoring station will optionally call via telephone to confirm that there is no emergency and may send a second confirmation signal or a separate signal indicating that the alert signal has been dismissed as not an authentic emergency. If the monitoring station determines that there is a true emergency 86, it will notify the appropriate authorities, including the police or an emergency rescue team.

Figure 5:
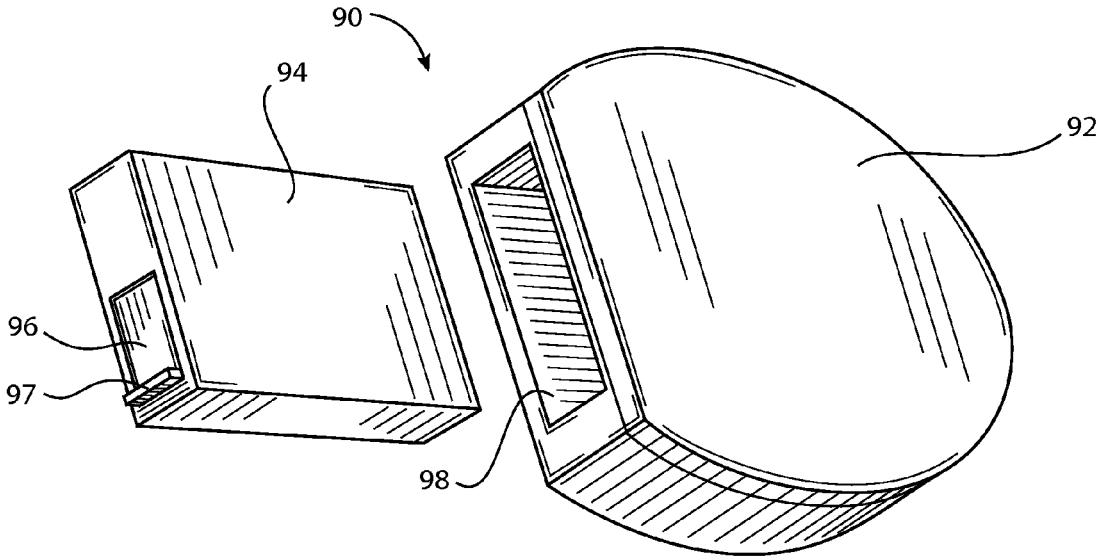
FIG. 5 is an alternative embodiment of the invention.

FIG. 5 shows an alternative embodiment of the invention 90. Security device 90 comprises a case 94 containing all of the electronics of the invention, including the central processor, location module, confirmation indicator(s), transceiver and power source. Embodiment 90 also includes an outer concealment case 92. Concealment case 92 is designed to look like a common item found in a purse or pocket. Concealment case 92 may be designed to look like a make-up case. Alternatively, concealment case 92 may look like a pendant, amulet, brooch or other decorative item. Preferably, a variety of concealment cases are available to suit the aesthetic tastes of different operators. The case 94 fits within cavity 98 of the concealment case, disguising the true nature of the device. This assists in preventing an assailant from identifying the nature of the device and discovering that an alert signal has been or may be sent.

Case 94 also includes a slidable trigger cover 96. slidable cover 96 covers the trigger so that it may not be accidentally depressed. This prevents accidental activation of the trigger and accidental transmission of an alert signal. Because this embodiment includes a trigger cover, a plurality of steps is required to activate the trigger. First the trigger cover 96 must be slid to the side and then the trigger must be depressed for a predetermined amount of time. Cover 96 is preferably held in place by any of a number of mechanism known in the art to snap a cover into place and may be pushed back by engaging tab 97. Sliding the cover and depressing the trigger may be accomplished with one hand. The design reduces the likelihood of an accidental transmission of an alert signal while still providing for a simple method of activating the trigger.

Figure 6:
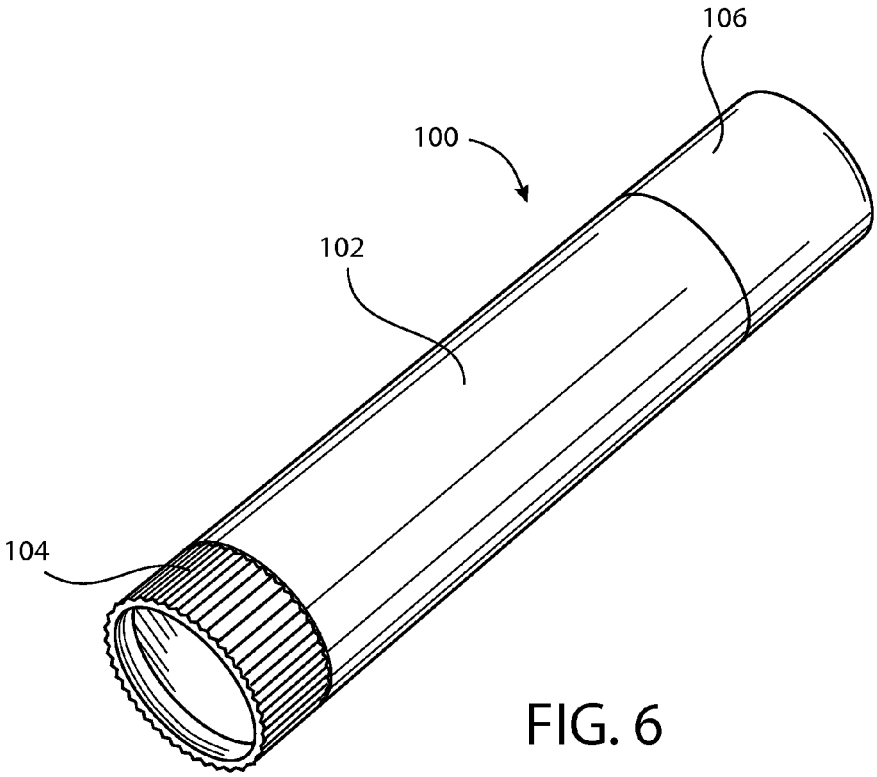
FIG. 6 is an alternative embodiment of the invention.

FIG. 6 shows another alternative embodiment of the invention 100. Embodiment 100 includes a case 102 designed to look like a common item in a purse or pocket. In this particular embodiment, case 102 is cylindrical and has the appearance of a stick of lip balm. This embodiment 100 includes a trigger 104 that is activated by twisting a predetermined number of times. Cap 106 enhances the deceptive appearance of the device by covering a recharging jack or any other components desirably hidden. This embodiment includes a vibrator as the confirmation indicator. Those skilled in the art will appreciate that the device may be similarly designed to appear as a lipstick tube or other similar object.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A security device comprising: a control module;

a transceiver in communication with the control module, the transceiver operable for sending and receiving signals;

a trigger in communication with the control module, the trigger operable to actuate transmission of a signal by the transceiver;

a location module in communication with the control module, the location module identifying a location of the security device;

a microphone coupled to the control module;

wherein the control module, transceiver, trigger, location module and microphone are disposed within an outer concealment casing;

a cover slidably positionable about the trigger; and an impinging a verification switch to verify that the security device is functioning properly.

2. The security device of claim 1, further comprising a confirmation indicator in communication with the control module, the confirmation indicator conveying a confirmation signal when the transceiver receives a receipt signal.

3. The security device of claim 2, wherein the confirmation indicator provides a vibrating response.

4. The security device of claim 2, wherein the confirmation indicator includes an illuminating device.

5. The security device of claim 2, wherein the confirmation indicator includes an audio device.

6. The security device of claim 1, wherein the transceiver sends an alert signal including a device identifier, a location of the security device and an audio signal upon actuation of the trigger.

7. The security device of claim 1, wherein the location module includes a Global System for Mobile device.

8. The security device of claim 1, wherein the location module includes a Global Positioning System device.

9. The security device of claim 1, wherein the location module includes an Assisted Global Positioning System device.

10. The security device of claim 1, wherein the transceiver includes a Subscriber Identity Module.

11. A method for summoning emergency assistance, comprising:

providing a security device comprising a control module, a location module, a device identifier module, a transceiver, a trigger, a confirmation indicator and a microphone;

activating the trigger, wherein activation of the trigger actuates the transceiver to send an alert signal including a security device identity, a security device location and an audio signal to a monitoring station;

transmitting a receipt signal form the monitoring station to the transceiver; and actuating the confirmation indicator upon receipt of the receipt signal;

wherein the control module, transceiver, trigger, location module and microphone are disposed within an outer concealment casing;

a cover slidably positionable about the trigger; and an impinging a verification switch to verify that the security device is functioning properly.

12. The method of claim 11, further comprising contacting an emergency assistance provider.

13. The method of claim 11, wherein activating the trigger includes depressing the trigger for a predetermined length of time.

14. The method of claim 11, wherein activating the trigger includes depressing the trigger until the security device receives the receipt signal.

15. The method of claim 11, wherein activating the trigger includes depressing the trigger a plurality of times.

* * * * *